United States Patent [19]

Squarcialupi

[11] 4,182,671

[45] Jan. 8, 1980

[54] ELECTROLYTIC SILVER AND GOLD REFINING CELL

[75] Inventor: Sergio Squarcialupi, Arezzo, Italy

[73] Assignee: Chimet S.p.A., Badia Al Pino, Italy

[21] Appl. No.: 900,997

[22] Filed: Apr. 28, 1978

[30] Foreign Application Priority Data

May 11, 1977 [IT] Italy ..... 49357 A/77

[51] Int. Cl.[2] ..... C25C 7/00; C25C 1/20

[52] U.S. Cl. ..... 204/276; 204/109; 204/269

[58] Field of Search ..... 204/109, 238, 276, 269, 204/257

[56] References Cited

U.S. PATENT DOCUMENTS

| | | | |
|---|---|---|---|
| 668,842 | 2/1901 | Rouse | 204/269 |
| 1,344,681 | 6/1920 | Dalziel | 204/269 X |
| 2,655,473 | 10/1953 | Lowenheim | 204/269 X |
| 3,431,187 | 3/1969 | Lancy | 204/109 |
| 3,836,443 | 9/1974 | MacGregor | 204/109 X |

*Primary Examiner*—John H. Mack
*Assistant Examiner*—D. R. Valentine
*Attorney, Agent, or Firm*—Wigman & Cohen

[57] ABSTRACT

The present invention relates to an electrolytic gold and silver refining cell for extracting gold and silver contained in a material. The cell is part of a plurality of cells arranged in at least one common vessel provided with a solution feeding inlet, an exhausted solution outlet, and a stirrer. The cell is also provided with a plate cathode consisting of an acid-proof material and a plate anode consisting of the abovementioned material containing Au and Ag. The material is introduced into a filtering bag. The cathode and anode electrodes are suspended parallel to each other within the common vessel and are inserted in parallel in a d.c. supplied network. The invention is characterized by the fact that the vessel, housing a plurality of side by side cells, is provided with a hopper bottom with an outlet conduit controlled by a first normally open valve and connected to a larger conduit provided at its end with a second normally closed valve. Each of the filtering bags is provided with a bottom inclined towards its center. Each bag contains a pipe that extends along one of the vertical sides of the bag and along its inclined bottom to the center thereof. The pipe is connected outside the vessel with a manifold connected in turn with a pump assembly having a delivery pipe which is connected with the device for recovering the metal, in particular gold, which is formed on the anode.

9 Claims, 3 Drawing Figures

ELECTROLYTIC SILVER AND GOLD REFINING CELL

BACKGROUND OF THE INVENTION

1. Field of the Invention.

The present invention relates to an electrolytic cell, particularly for parting gold and silver from a material containing these noble metals. This cell is such as to remove gold and silver separated from each other without stopping the treatment. However, the cell of the invention can be used for other similar applications.

2. Description of the Prior Art

It is well known that in the plants for gold and silver working it is very important to recover of the precious metals that are in the form of working shavings or dust which can fall either on the ground or on the workmen's overalls whereby it is necessary to carry out a recovery operation by treating the washing waters of the garments as well as the waste or the like.

Normally, such wastes are treated so as to extract all the metallic materials contained therein, which besides the above mentioned precious metals, may sometimes include also other metals, in particular copper. Therefore, the wastes are subjected to several treatments among which is a thermal one, in order to eliminate the remainder of not metallic materials so as to obtain, by way of casting, the plates containing Cu, Ag and Au. From these plates the gold and the silver is extracted by means of an electrolytic process carried out in a plant in which a plurality of anodes and cathodes contained within at least one vessel are operated in a cascade connection and wherein filtering bag frames of porous tissue containing an anode plate consisting of the material to be treated, which includes Au and Ag, are removable suspended. Outside thereof, a bath proof cathode plate, consisting particularly of stainless steel, is also suspended.

These electrodes are respectively connected in parallel in a network supplied by a d.c. source. The bath consists of a solution of nitric acid and silver nitrate.

Plants are well known wherein silver particles are formed on the cathode and are collected on the vessel bottom, while the gold particles are formed on the anode and collected on the bottom of the filtering bags.

Therefore, after the plant is operated for a predetermined time the working is stopped in order to draw the gold by extracting the filtering bags and to take up the silver from the vessel bottom where the silver crystals are deposited. This stoppage involves a long and labourious operation that lowers the plant efficiency.

SUMMARY OF THE INVENTION

The present invention proposes to modify the electrolytic cell in order to take up the parted materials periodically and without stopping the operation.

BRIEF DESCRIPTION OF THE DRAWING

These and other features of the invention by will be more apparent from the following description of an embodiment of the invention referring to the annexed drawings, wherein.

DETAILED DESCRIPTION OF THE PREFERRED EMBODIMENT

Figure 2:
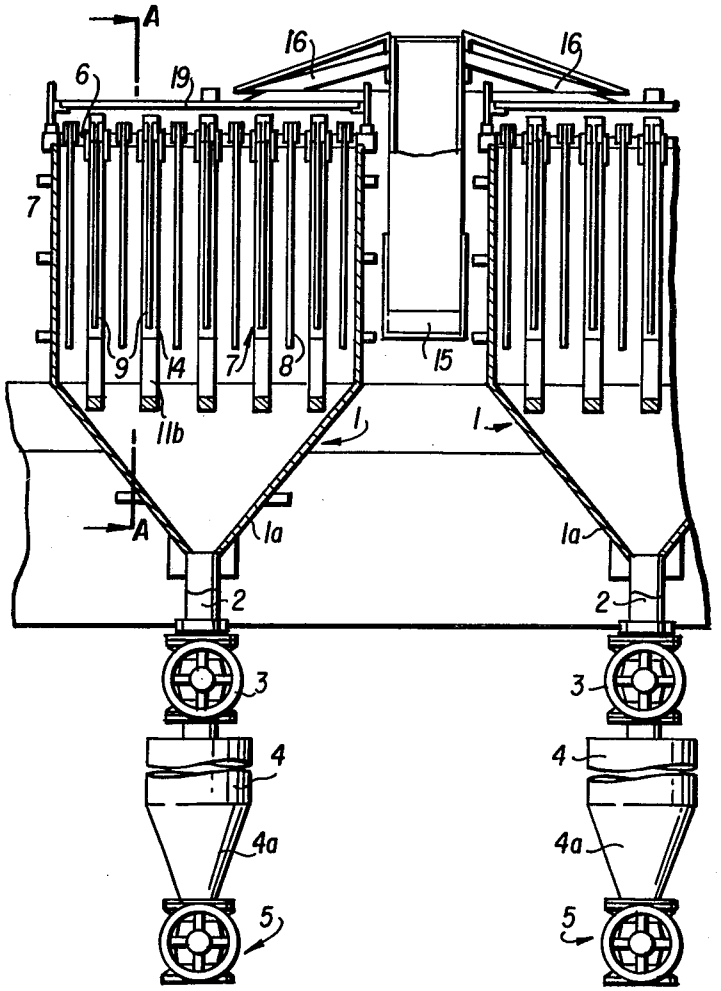
FIG. 2 illustrates in cross section the vessel containing a plurality of cells and a portion of the subsequent vessel.

Referring to the illustrated embodiment it is generally indicated with 1 a vessel containing a plurality of cells and provided with a pyramidal hopper bottom 1*a* that leads to a central outlet conduit 2 wherein it is provided a first valve 3 to which a larger conduit 4 is connected that terminates with a truncated-cone length 4*a* at the end of which a second valve 5 is provided. The internal space in the conduit 4, 4*a* is dimensioned so as to contain the material that decants on the bottom 1*a* of the vessel 1 before being taken away. Along the lengthwise edges of the vessel 1, which is well known, supports 6 with a slit series are provided, for supporting at predetermined distances alternately the filtering bags, generally indicated with 7, and the cathode and anode plates 8 and respectively 9 (FIG. 2), the latter being introduced within the filtering bags 7 according to a well known technique. For each cell it is provided a stirrer (not shown) that is hung up to the frame 10 and is alternately moved by the carriage 19 transversely with respect to the vessel 1, 1*a*.

According to the present invention, the bags 7 are formed in a not conventional manner and consist of an upper support frame 10 of rectangular form that extends upwards with hook arms 10*a*, which engage the slit of the support 6. Further, the frame 10, 10*a* extends downwards and along the bottom of the filtering bag 7 with a second frame of pentagonal form generally indicated with 11, consisting of two vertical rods 11*a* and two rods 11*b* inclined downwards and towards the center.

Figure 3:
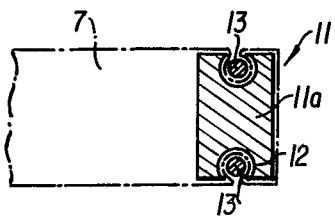
FIG. 3 is a detail in enlarged scale of the section along the line B—B of FIG. 1.
Figure 1:
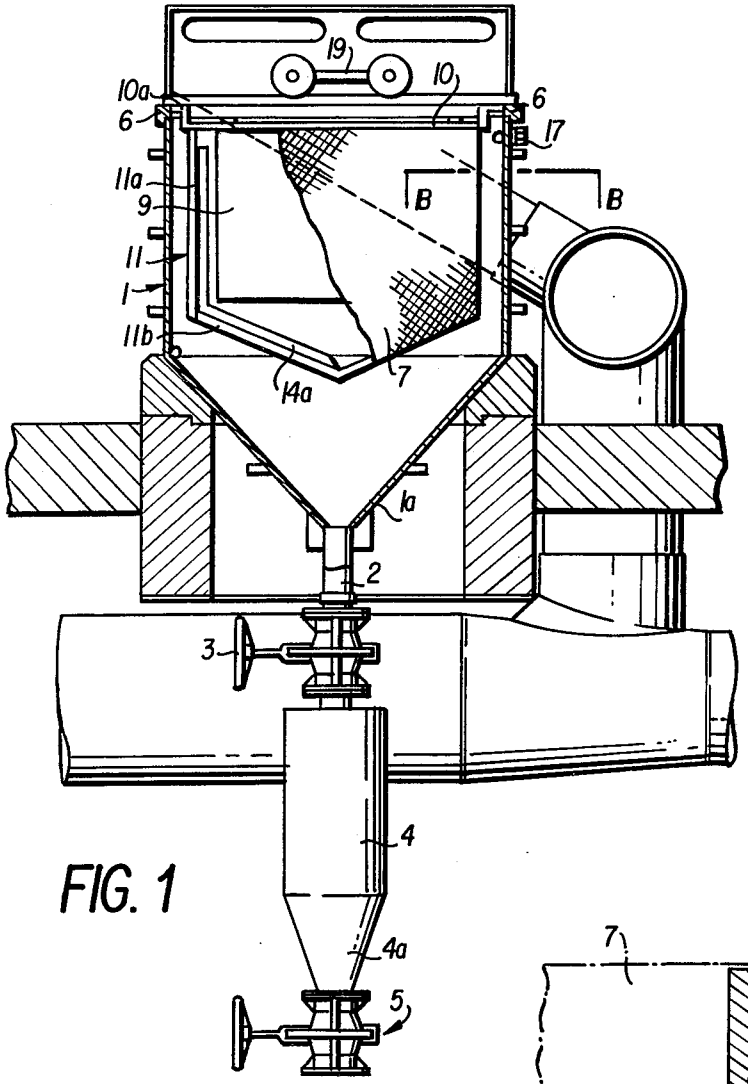
FIG. 1 is the schematic cross section along the line A—A in FIG. 2 of an electrolytic cell of a plant comprising a double plurality of cells respectively contained into two vessels.

The frame 11 consists of rigid plastic material that is slightly elastic and acid proof, in particular polypropylene, and is provided along the transversal faces of its vertical rods 11*a* and bottom rods 11*b* with circular slots 12 (FIG. 3) opened outwards with a longitudinal opening whose width is a little smaller than the diameter of the slots 12. These slots 12 are provided in order to allow a removable assembling of two parallel cloths of filtering tissue 7, e.g. also consisting of polypropylene. The tissue 7 is fixed within such slots 12 (FIG. 3) by partially winding this tissue about rods 13 that are embedded within the slots 12, whose lengthwise edges are therefore resiliently deformed owing to the selected material for such frames 11. The bags 7 have the bottom formed by two junction lines inclined to the center of the bag 7 and towards the lowest point thereof. It is indicated with 14 an upwardly opened flute mouth pipe which is shaped so that its first length 14*a* extends along one of the bottom junction lines of the filtering bag 7 and its second length 14*b* extends vertically along the side edge of the bag 7 and is connected to a manifold that leads to a pump assembly (not shown).

In the vessel 1, 1*a*, by means of a central duct 15 and through the corresponding inlet pipe 16 a solution is introduced comprising 10 to 20 g/l of nitric acid and 100 g/l of silver nitrate. As a consequence of the electric current flow, is formed anode slime is formed containing gold on the anode 9 and silver on the cathode 8.

Therefore, slime containing gold precipitates on the bottom of the bag 7, while the silver crystals are deposited on the hopper bottom 1*a* of the vessel 1. During operation the valve 3 is open and the valve 5 is closed whereby the silver decants in the conduit 4, 4*a*.

At predetermined intervals the pump is operated for the suction of the gold slime from the bottom of the bag 7 through the pipe 14*a*, 14*b*. The same pump conveys the gold slime to the subsequent recovery treatment. For taking away the silver the valve 3 is closed in order to avoid a bath liquid leak and the valve 5 is opened for taking away the silver slime along with an irrelevant amount of the bath liquid.

The treatment can thus continue also during the taking away of the deposited materials. It is indicated with 17 an outlet of the exhausted bath provided at the upper end of the vessel 1 opposite to that inlet where the solution is supplied. Although the invention is illustrated and described with reference to the gold and silver recovery it should be apparent that the electrolytic cell of the invention can be used also for the recovery of other materials by varying conveniently the bath.

What I claim is:

1. Electrolytic gold and silver refining cell for extracting gold and silver contained in a material, said cell being part of a plurality of cells arranged in at least one common vessel provided with a solution feeding inlet and an exhausted solution outlet, said cell being also provided with a plate cathode consisting of an acid proof material and a plate anode consisting of said material containing gold and silver and being introduced into filtering bags, said cathode and anode being suspended within the cell arranged in said common vessel, characterized by the fact that:

said common vessel is provided with a hopper bottom having an outlet conduit controlled by a first normally open valve and connected to another conduit provided at its end with a second normally closed valve; and each of said filtering bags is provided with a bottom inclined towards its center and containing a pipe that extends along one of its vertical sides and along said inclined bottom to the center thereof.

2. Cell as set forth in claim 1, wherein the pipe within each of said filtering bags is provided with an upwardly opened mouth at its lower end.

3. Cell as set forth in claim 1, wherein each of the filtering bags consists of a support frame comprising a first upper frame that extends at its ends with hook arms, a second vertical frame connected with the first frame and comprising two vertical side rods and two bottom rods inclined towards the center of the bottom of the second frame, said second frame supporting side walls of the filtering bags and separating said side walls from each other.

4. Cell as set forth in claim 3, wherein the second vertical frame consists of rods provided, on opposite faces corresponding to the side walls of the filtering bags, with slots, said slots housing edges of filtering cloths of the side walls of the filtering bags and also housing rod means for fixing said edges of the filtering cloths against walls of said slots whose rims are able to be elastically deformed in order to allow the rod means to fix the edges of the filtering cloths.

5. Cell as set forth in claim 1, wherein the filtering bags are made of plastic material.

6. Cell as set forth in claim 5, wherein the plastic material is polypropylene.

7. Cell as set forth in claim 3, wherein the support frame is made of plastic material.

8. Cell as set forth in claim 4, wherein the slots have a substantially circular shape.

9. In an electrolytic cell for extraction of gold and silver metals from a plate containing said metals in combination with other metals, which cell comprises a vessel in which a plurality of anodes and cathodes, prepared in the form of plates, are suspended in spaced relationship, wherein the cathodes are made of insoluble material and the anodes are made of a mixture of said metals, and wherein each of said anodes is received within a separate filtering bag and the vessel is provided with an inlet for the bath solution and with an outlet for the exhausted solution, the improvements comprising the fact that:

the vessel has a funnel-like bottom extending into an outlet conduit, the entrance orifice of which is controlled by a first valve which normally closes while the outlet orifice is controlled by a second valve which normally opens, and each filtering bag has a bottom inclined towards its center and contains a pipe extending along the inner side of said filtering bag and opening near the bottom center of said filtering bag.

* * * * *